US010008315B2

(12) United States Patent
Okada et al.

(10) Patent No.: US 10,008,315 B2
(45) Date of Patent: Jun. 26, 2018

(54) MAGNETIC CIRCUIT

(71) Applicant: Mitsubishi Electric Corporation, Chiyoda-ku (JP)

(72) Inventors: Masaaki Okada, Tokyo (JP); Tomokazu Ogomi, Tokyo (JP); Hiroyuki Asano, Tokyo (JP); Takeshi Kishimoto, Tokyo (JP); Kenji Shimohata, Tokyo (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days. days.

(21) Appl. No.: 15/599,738

(22) Filed: May 19, 2017

(65) Prior Publication Data

US 2017/0256347 A1 Sep. 7, 2017

Related U.S. Application Data

(62) Division of application No. 14/369,772, filed as application No. PCT/JP2013/051104 on Jan. 21, 2013, now Pat. No. 9,691,533.

(30) Foreign Application Priority Data

Jan. 30, 2012 (JP) ..... 2012-016847

(51) Int. Cl.
*H01F 7/02* (2006.01)

(52) U.S. Cl.
CPC ..... *H01F 7/021* (2013.01)

(58) Field of Classification Search
CPC ..... H01F 7/00; H01F 7/02; H01F 6/00; H16F 7/10

(Continued)

(56) References Cited

U.S. PATENT DOCUMENTS 2,862,752 A 12/1958 Heppner
3,412,352 A 11/1968 Watson (Continued)

FOREIGN PATENT DOCUMENTS

CN 1279486 1/2001
CN 1771006 A 5/2006

(Continued)

OTHER PUBLICATIONS

Final Office Action dated Feb. 3, 2017 in Chinese Patent Application 201380007289.3 (w/Partial English translation).

(Continued)

*Primary Examiner* — Shawki S Ismail
*Assistant Examiner* — Lisa Homza
(74) *Attorney, Agent, or Firm* — Oblon, McClelland, Maier & Neustadt, L.L.P.

(57) ABSTRACT

A magnetic circuit, provided with a short magnet (1*a*) and short magnet (1*b*) that are arranged in an array, and a yoke (2*a*) and a yoke (2*b*) provided so as to sandwich the short magnet (1*a*) and short magnet (1*b*). The short magnet (1*a*) and short magnet (1*b*), are arranged, that have a space between them that is a predetermined gap (3) or less in the arrangement direction of the array respectively. In addition, the short magnet (1*a*) and short magnet (1*b*) are arranged so that one magnetic pole is located on the side toward one of the pair of yokes (2*a*) and (2*b*), and the other magnetic pole is located on the side toward the other yoke.

6 Claims, 14 Drawing Sheets

(58) Field of Classification Search
USPC ..... 335/306
See application file for complete search history.

(56) References Cited

U.S. PATENT DOCUMENTS

| | | | | |
|---|---|---|---|---|
| 3,418,613 | A | 12/1968 | Trikilis | |
| 3,585,549 | A | 6/1971 | Muller | |
| 3,860,895 | A | 1/1975 | Chow | |
| 4,090,162 | A | 5/1978 | Cardone | |
| 4,544,067 | A * | 10/1985 | Miller | B25H 3/04 211/70.6 |
| 4,614,929 | A | 9/1986 | Tsukuda | |
| 4,672,346 | A | 6/1987 | Miyamoto | |
| 4,679,022 | A | 7/1987 | Miyamoto | |
| 4,777,464 | A | 10/1988 | Takabatashi | |
| 4,818,966 | A | 4/1989 | Miyamoto | |
| 5,097,240 | A | 3/1992 | Nakanishi | |
| 5,109,172 | A | 4/1992 | Pace | |
| 5,218,333 | A | 6/1993 | Kobayashi | |
| 5,445,249 | A | 8/1995 | Aida | |
| 5,512,872 | A | 4/1996 | Ohashi | |
| 5,642,089 | A | 6/1997 | Lysen | |
| 5,896,961 | A | 4/1999 | Aida | |
| 6,111,491 | A | 8/2000 | Furuse | |
| 6,147,578 | A | 11/2000 | Panfil | |
| 6,163,240 | A | 12/2000 | Zuk | |
| 6,172,589 | B1 | 1/2001 | Fujita | |
| 6,356,177 | B1 | 3/2002 | Ogura | |
| 6,614,337 | B1 * | 9/2003 | Winnard | B25B 11/002 206/350 |
| 6,719,155 | B1 | 4/2004 | Chang | |
| 7,023,310 | B2 | 4/2006 | Oohashi | |
| 7,545,250 | B2 | 6/2009 | Reymann | |
| 8,354,907 | B2 | 1/2013 | Fukaya | |
| 2006/0077027 | A1 | 4/2006 | Aoki | |
| 2006/0232368 | A1 | 10/2006 | Gorshkov | |
| 2006/0232369 | A1 | 10/2006 | Gorshkov | |
| 2006/0255894 | A1 | 11/2006 | Enomoto | |
| 2007/0182517 | A1 | 8/2007 | Humphries | |
| 2007/0244385 | A1 | 10/2007 | Satragno | |
| 2007/0257758 | A1 | 11/2007 | Chen | |
| 2008/0048127 | A1 | 2/2008 | Murphy | |
| 2008/0204174 | A1 | 8/2008 | Ito | |
| 2008/0218007 | A1 | 9/2008 | Masuzawa | |
| 2009/0072939 | A1 | 3/2009 | Shen | |
| 2009/0236219 | A1 | 9/2009 | Endo | |
| 2009/0237080 | A1 | 9/2009 | Kato | |
| 2009/0243775 | A1 | 10/2009 | Kim | |
| 2010/0214047 | A1 | 8/2010 | Sakai | |
| 2010/0219833 | A1 | 9/2010 | McGinley | |
| 2010/0294061 | A1 | 11/2010 | Shibata | |
| 2011/0012440 | A1 | 1/2011 | Toyota | |
| 2011/0063060 | A1 | 3/2011 | Chang | |
| 2011/0180401 | A1 | 7/2011 | Endo | |
| 2011/0248806 | A1 | 10/2011 | Michael | |
| 2012/0051580 | A1 | 3/2012 | Wei | |
| 2012/0160673 | A1 | 6/2012 | Endo | |
| 2013/0169395 | A1 | 7/2013 | Ihara | |
| 2014/0028426 | A1 | 1/2014 | Fullerton | |
| 2014/0085024 | A1 | 3/2014 | Kuriyama | |
| 2014/0285296 | A1 | 9/2014 | Nagahara | |
| 2015/0042430 | A1 | 2/2015 | Fullerton | |

FOREIGN PATENT DOCUMENTS

| | | | |
|---|---|---|---|
| CN | 101581772 | A | 11/2009 |
| JP | 52-51100 | | 4/1977 |
| JP | 61-114148 | A | 5/1986 |
| JP | 02-074010 | | 3/1990 |
| JP | 08-316025 | | 11/1996 |
| JP | 09-159068 | | 6/1997 |
| JP | 10-047651 | | 2/1998 |
| JP | 2-118479 | | 9/1998 |
| JP | 2003-116290 | A | 4/2003 |
| JP | 4801568 | B2 | 10/2011 |
| WO | WO 97/28544 | A1 | 8/1997 |

OTHER PUBLICATIONS

Office Action dated Oct. 17, 2016 in Chinese Patent Application No. 201380007289.3 (with English language translation).
Office Action dated May 11, 2016 in Chinese Patent Application No. 201380007289.3 (with English translation).
Office Action dated Nov. 27, 2015 in Korean Patent Application No. 10-2014-7019004 (with English language translation).
Chinese Office Action dated Nov. 20, 2015 for Chinese Patent Application No. 201380007289.3 (and English translation of relevant portions thereof).
Extended European Search Report dated Oct. 30, 2015 in Patent Application No. 13744110.1.
Office Action dated May 20, 2015 in Korean Patent Application No. 10-2014-7019004 (with English language translation).
International Search Report dated Apr. 23, 2013, in PCT/JP13/051104, filed Jan. 21, 2013.
Japanese Office Action dated Feb. 10, 2015 in Patent Application No. 2013/556319 (with English translation).
Office Action dated Jan. 30, 2018 in Chinese Patent Application No. 201380007289.3 (with English translation ).

* cited by examiner

MAGNETIC CIRCUIT

The present application is a divisional application of and claims the benefit of priority from U.S. application Ser. No. 14/369,772, filed Jun. 30, 2014, which is a National Stage of and claims the benefit of priority from Application No. PCT/JP2013/051104, filed Jan. 21, 2013, which claims the benefit of priority from Japanese Application No. 2012-016847, filed Jan. 30, 2012; the entire contents of each of the above are hereby incorporated herein by reference.

TECHNICAL FIELD

The present invention relates to a long magnetic circuit.

BACKGROUND ART

Unexamined Japanese Patent Application Kokai Publication No. H10-47651 (refer to Patent Literature 1) discloses a long magnetic circuit in which a plurality of permanent magnets are arranged with a space between so that surfaces having the same magnetic polarity face each other, and a plurality of magnetic yokes are inserted between each of the permanent magnets so that the permanent magnets and magnetic yokes come in close contact.

Unexamined Japanese Patent Application Kokai Publication No. H09-159068 (refer to Patent Literature 2) discloses a sandwiched-type magnetic circuit in which both sides in the magnetic pole direction of a permanent magnet are sandwiched between yokes, and is a magnetic adhesion member for pipelines that is used in a magnetic pipeline hoist that adheres to a solid magnetic body when hoisting and supporting pipeline.

CITATION LIST

Patent Literature

Patent Literature 1: Unexamined Japanese Patent Application Kokai Publication No. H10-47651

Patent Literature 2: Unexamined Japanese Patent Application Kokai Publication No. H09-159068

SUMMARY OF INVENTION

Technical Problem

In the invention disclosed in Patent Literature 1, a plurality of permanent magnets are arranged with a space between so that surfaces having the same magnetic polarity face each other, so there was a problem in that the magnetic field intensity distribution in the length direction was not uniform.

In the invention disclosed in Patent Literature 2, by making a sandwiched type magnetic circuit in which both sides in the magnetic pole direction of a permanent magnet are sandwiched between yokes, the magnetic field intensity of the magnetic circuit is strengthened, however, in order to form a long sandwiched type magnetic circuit, a long permanent magnet is necessary, and there was a problem in that processing a long permanent magnet is difficult and the long permanent magnet breaks easily.

In order to solve the problems above, the object of the present disclosure is to obtain a long magnetic circuit that uses a plurality of short magnets that are arranged in an array, and that has a uniform magnetic flux density distribution in the array direction.

Solution to Problem

The magnetic circuit of this invention comprises: a plurality of magnets that are arranged in an array; and a pair of yokes that are provided so as to sandwich the plurality of magnets; wherein the plurality of magnets are arranged respectively with a predetermined gap or less between the magnets in the arrangement direction of the array, and have one magnetic pole that is on the side of one of the pair of yokes, and the other magnetic pole on the side of the other of the pair of yokes.

Advantageous Effects of Invention

The magnetic circuit of this invention comprises a plurality of magnets that are arranged in an array and spaced apart by a predetermined gap or less, and yokes that are provided on the plurality of magnets, so it is possible to obtain uniform magnetic flux density in the arrangement direction of the array even when adjacent magnets are not in close contact with each other.

Moreover, it is possible to use magnets having a short length and high production yield, so productivity is improved.

DESCRIPTION OF EMBODIMENTS

Embodiment 1

Figure 1:
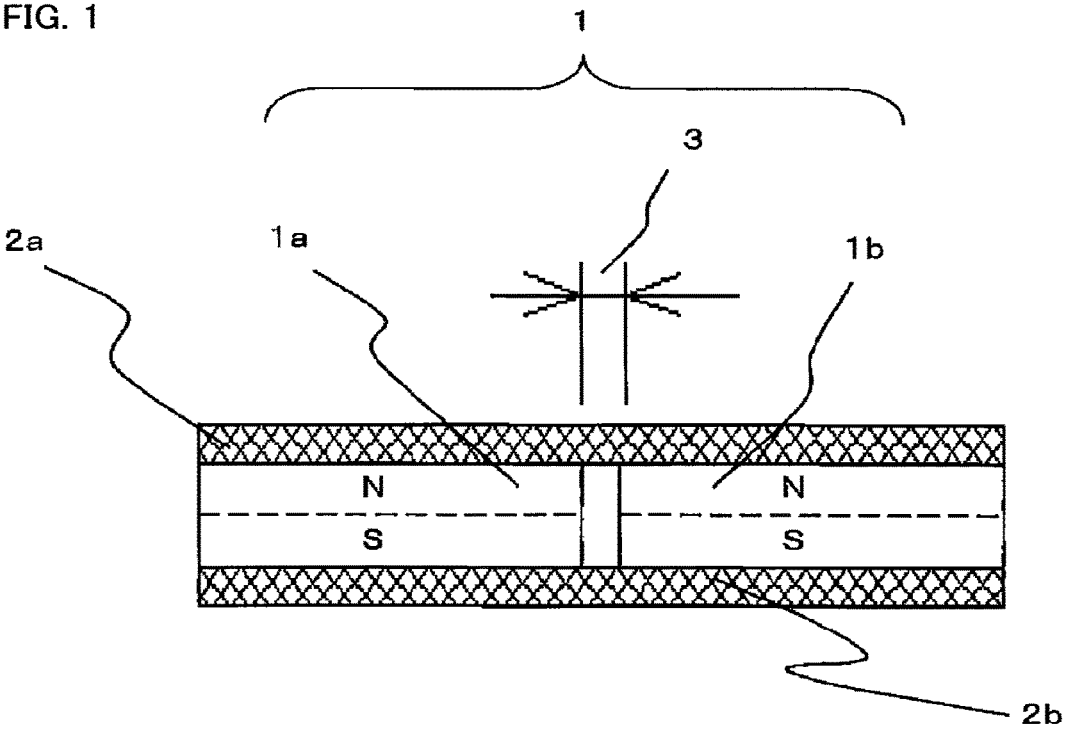
FIG. 1 is a side view of a magnetic circuit of a first embodiment of the present disclosure.
Figure 2:
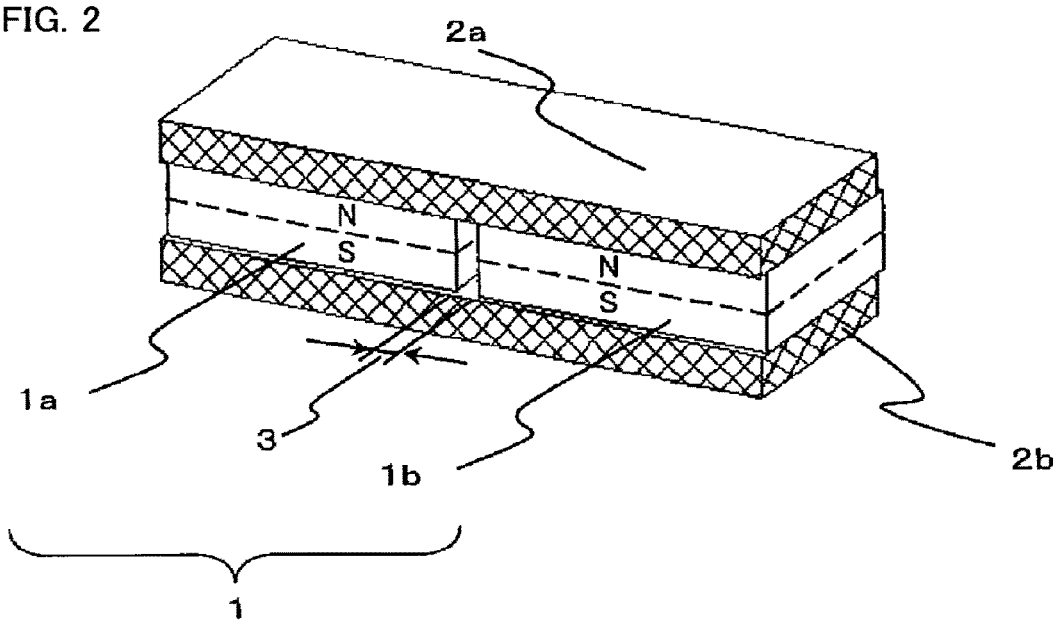
FIG. 2 is a perspective view illustrating a magnetic circuit of a first embodiment of the present disclosure.

A first embodiment of the present disclosure will be explained using the drawings. FIG. 1 is a side view illustrating a magnetic circuit of a first embodiment of the present disclosure, and FIG. 2 is a perspective view illustrating a magnetic circuit of a first embodiment of the present disclosure. In FIG. 1 and FIG. 2, 1 is a magnet body, 1*a* and 1*b* are magnets, and 2*a* and 2*b* are ferrous-based metal yokes. The magnet body 1 comprises magnet 1*a* and magnet 1*b*. Magnet 1*a* and magnet 1*b* are arranged so that the magnetic poles are in the direction where the yoke 2*a* and yoke 2*b* are positioned respectively. Moreover, magnet 1*a* and magnet 1*b* are arranged so that the same magnetic poles are facing the same direction. For example, the magnet 1*a* and magnet 1*b* are arranged so that the N poles are on the side where the yoke 2*a* is located, and the S poles are on the side where the yoke 2*b* is located. Furthermore, the magnet 1*a* and magnet 1*b* are arranged in an array in the axial direction. The magnet 1*a* and magnet 1*b* are arranged so that there is a 2 mm gap 3 between the magnets, for example. A ferrous-based metal yoke 2*a* is provided in the magnetic circuit so as to span across the N pole of the magnet 1*a* and the N pole of the magnet 1*b*. A ferrous-based metal yoke 2*b* is provided in the magnetic circuit so as to span across the S pole of the magnet 1*a* and the S pole of the magnet 1*b*. The yoke 2*a* and yoke 2*b* are arranged so as to sandwich the magnet 1*a* and magnet 1*b* to form one body. The gap 3 between magnets can be an empty gap, or can be filled with a resin such as an adhesive and the like.

Figure 3A:
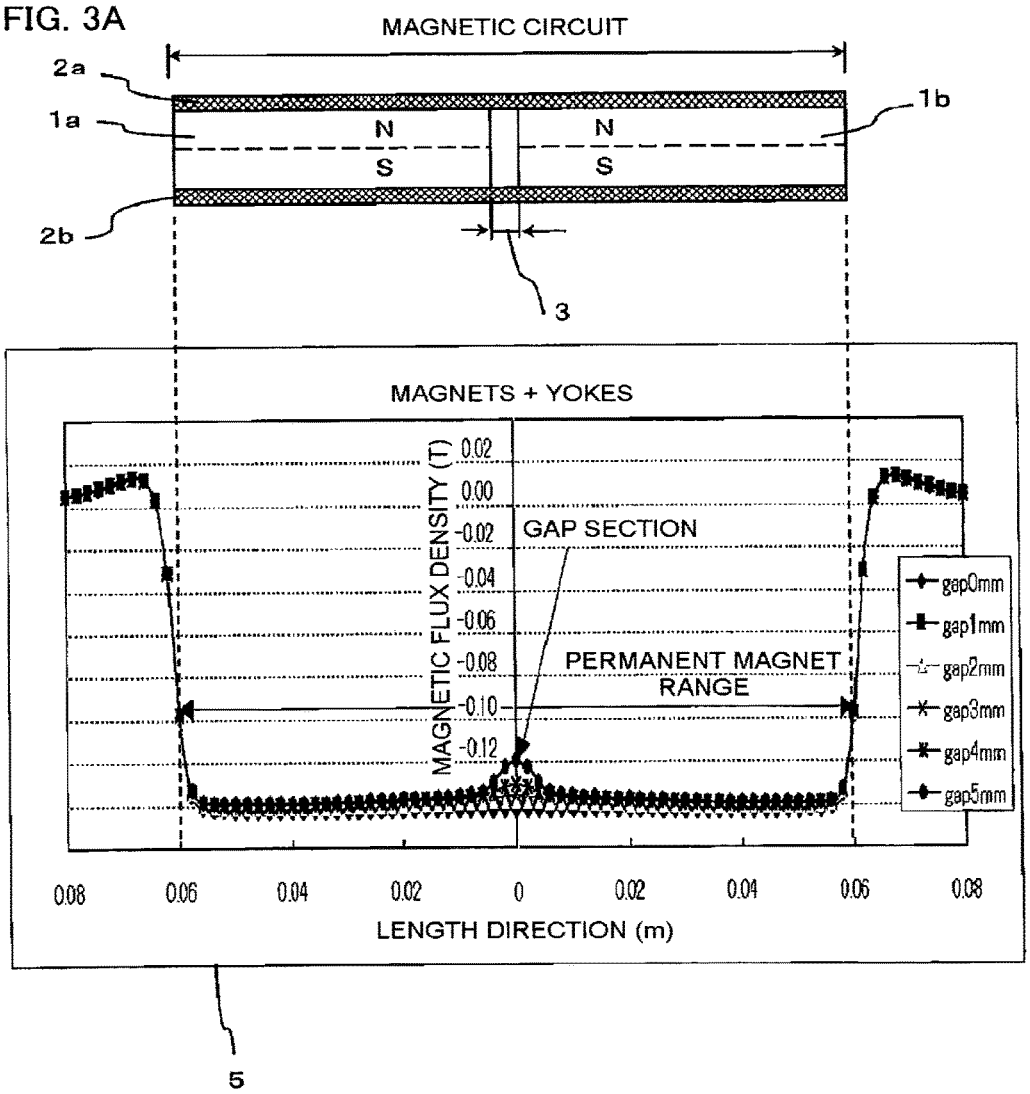
FIG. 3A is a drawing illustrating the magnetic flux density distribution of a magnetic circuit of a first embodiment of the present disclosure.
Figure 3B:
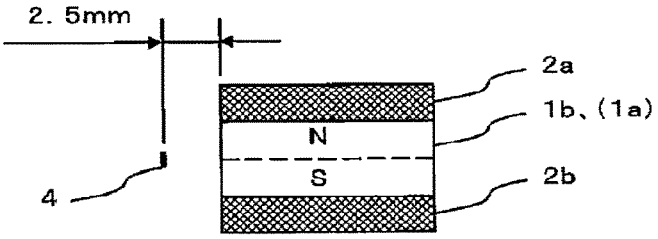
FIG. 3B is a drawing for explaining the installation position of a measurement device.

The operation of the magnetic circuit will be explained using FIG. 3A and FIG. 3B. FIG. 3A is a drawing illustrating the magnetic flux density distribution of the magnetic circuit of the first embodiment of the present disclosure. The same reference numbers are used for components that are the same as in FIG. 1, and explanations of those components will be omitted. In FIG. 3A, 5 is a graph illustrating the magnetic flux density distribution in the axial direction of the magnetic circuit at a position (position of a measurement device 4 that is illustrated in FIG. 3B) separated 2.5 mm from the surface of the magnets of the magnetic circuit in a direction that is orthogonal to the direction of the magnetic poles and the arrangement direction of the array.

In the graph 5 illustrated in FIG. 3A, the vertical axis is the magnetic flux density, and the horizontal axis is the length in the axial direction of the magnetic circuit. The dashed lines in FIG. 3A indicate the correspondence between the horizontal axis in the graph 5 and the magnetic circuit (in other words, the magnetic circuit is positioned in the permanent magnet range illustrated in the graph 5). In the graph 5, the magnetic flux density distribution is illustrated for the cases in which the gap 3 between the magnet 1*a* and the magnet 1*b* is changed from 0 mm to 5 mm. Even when the gap 3 between magnets becomes large, the magnetic flux density around the gap 3 between magnets does not fluctuate much. Furthermore, up to 3 mm of a gap 3 between magnets, the magnetic flux density around the gap 3 between magnets hardly fluctuates. Therefore, uniform magnetic flux density is obtained over the entire length in the axial direction of the magnetic circuit.

Figure 4:
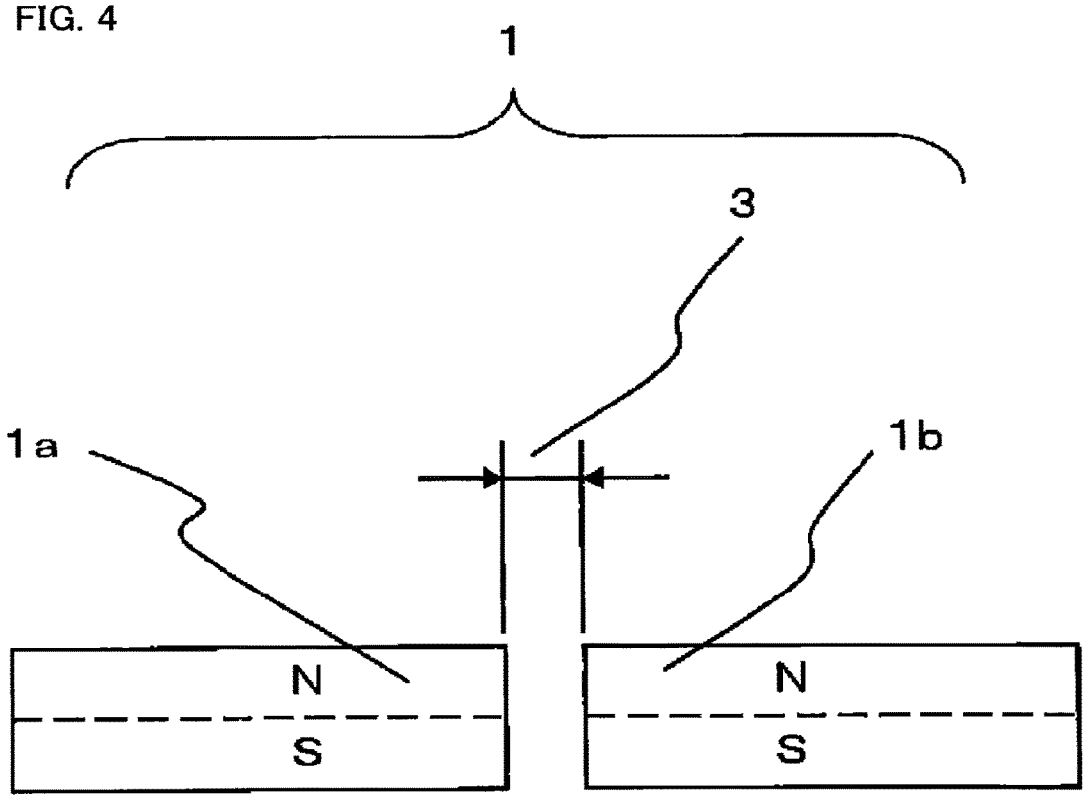
FIG. 4 is a side view of a magnetic circuit with the yokes removed from a magnetic circuit of a first embodiment of the present disclosure.

In order to explain the effect of the first embodiment of the present disclosure, the embodiment will be explained by comparing it with the case in which the yokes 2*a*, 2*b* are not provided. FIG. 4 is a side view of a magnetic circuit from which the yokes 2*a*, 2*b* have been removed from the magnetic circuit of the first embodiment of the present disclosure. In FIG. 4, the same reference numbers are used for components that are the same as those in FIG. 1, and an explanation of those components is omitted.

Figure 5A:
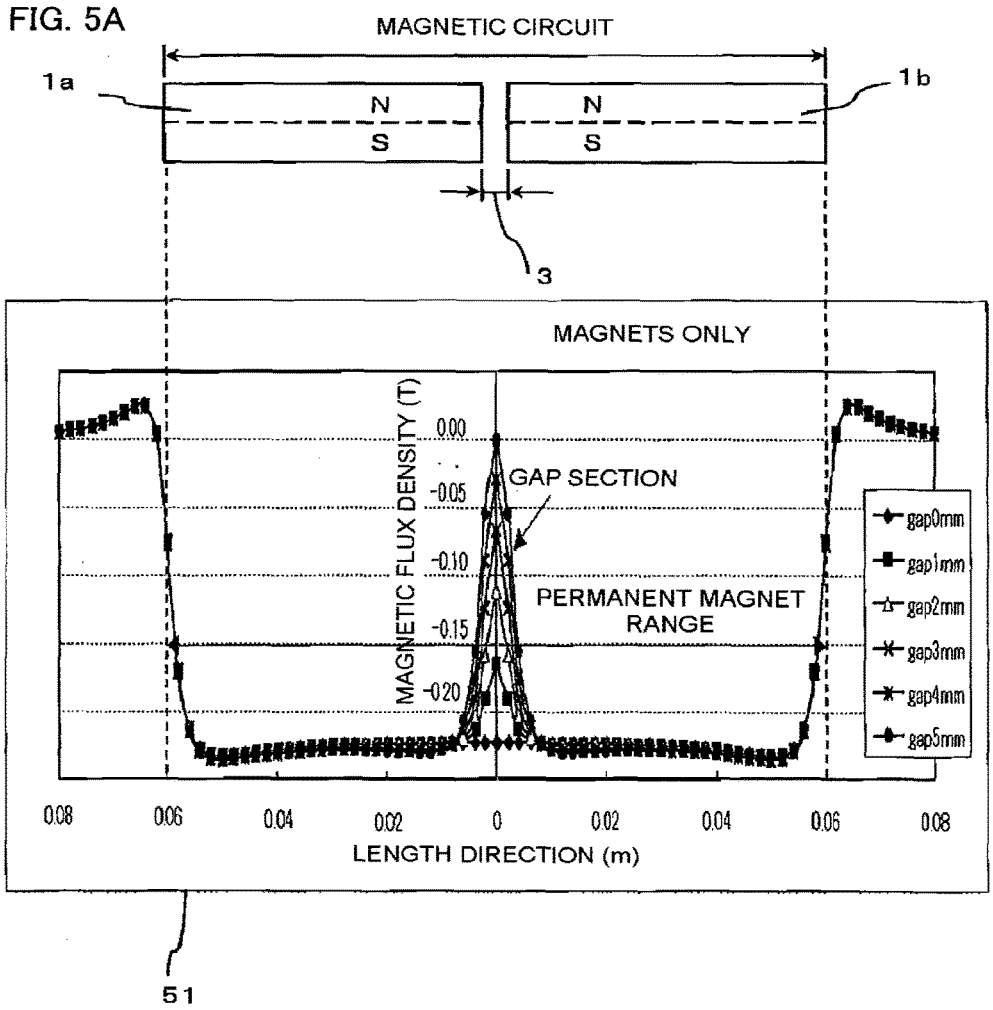
FIG. 5A is a drawing illustrating the magnetic flux density distribution of a magnetic circuit with the yokes removed from a magnetic circuit of a first embodiment of the present disclosure.
Figure 5B:
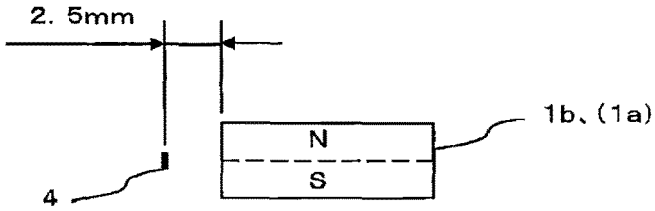
FIG. 5B is a drawing for explaining the installation position of a measurement device.

The operation of the magnetic circuit will be explained using FIG. 5A and FIG. 5B. FIG. 5A is a drawing illustrating the magnetic flux density distribution of a magnetic circuit from which the yokes have been removed from the magnetic circuit of the first embodiment of the present disclosure. In FIG. 5A and FIG. 5B, the same reference numbers will be used for components that are the same as those in FIGS. 3A and 3B, and explanations of those components will be omitted. In FIG. 5A, 51 is a graph illustrating the magnetic flux density distribution along the axial direction of the magnetic circuit at a position (position of a measurement device 4 that is illustrated in FIG. 5B) separated 2.5 mm from the surface of the magnets of the magnetic circuit in a direction that is orthogonal to the direction of the magnetic poles and the arrangement direction of the array.

In the graph 51 illustrated in FIG. 5A, the vertical axis is the magnetic flux density, and the horizontal axis is the length direction in the axial direction of the magnetic circuit. The dashed lines in FIG. 5A indicate the correspondence between the horizontal axis in the graph 51 and the magnetic circuit. In the graph 51, the magnetic flux density distribution is illustrated for the cases in which the gap 3 between the magnet 1*a* and the magnet 1*b* is changed from 0 mm to 5 mm. As the gap 3 between magnets becomes larger, the magnetic flux density around the gap 3 between magnets fluctuates even more. It can be seen that as the magnet 1*a* and the magnet 1*b* become separated, the magnetic flux density around the gap 3 between magnets fluctuates a large amount.

When the yoke 2*a* and the yoke 2*b* are not provided, a uniform magnetic flux density around the gap 3 between magnets cannot be maintained as the magnet 1*a* and the magnet 1*b* become separated.

As described above, with the magnetic circuit of the first embodiment of the present disclosure, even when the magnet 1*a* and the magnet 1*b* are not allowed to come in contact, as illustrated in FIGS. 3A, 3B, it is possible to suppress fluctuation of the magnetic flux density that occurs between the magnet 1*a* and the magnet 1*b*, as illustrated in FIGS. 5A, 5B, by providing ferrous-based metal yokes 2*a* and 2*b* that span across the magnet 1*a* and magnet 1*b*. As a result, it is possible to obtain a magnetic flux density that is uniform in the axial direction.

Figure 6:
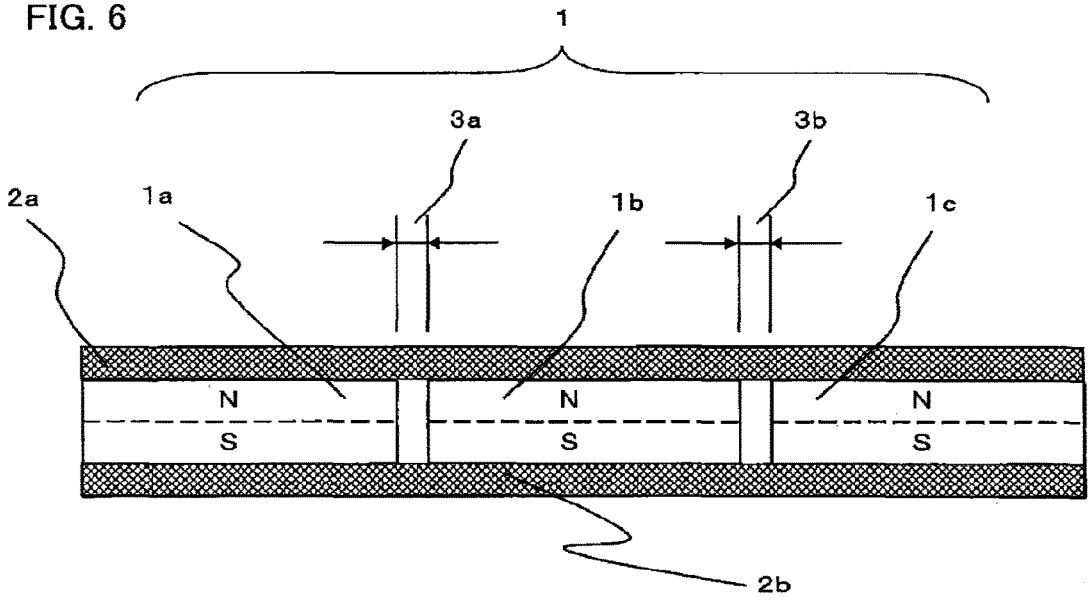
FIG. 6 is a side view of another example of a magnetic circuit of a first embodiment of the present disclosure.

In the first embodiment of the present disclosure, the case was explained in which two magnets were arranged in an array in the axial direction, however, as illustrated in FIG. 6, it is also possible to arrange three or more magnets in an array in the axial direction, and to provide yokes along all of the arranged magnets. The same effect as in the case of the magnetic circuit described above will be obtained.

Embodiment 2

Figure 7:
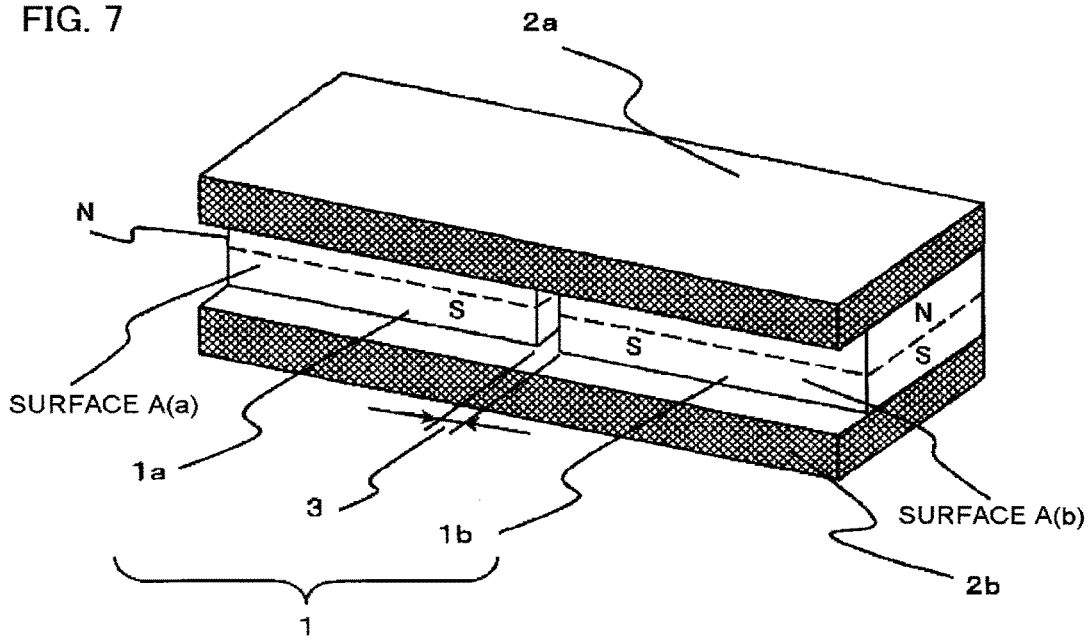
FIG. 7 is a perspective view illustrating a magnetic circuit of a second embodiment of the present disclosure.

A second embodiment of the present disclosure will be explained using the drawings. FIG. 7 is a perspective view of a magnetic circuit of the second embodiment of the present disclosure. In FIG. 7, the same reference numbers are used for components that are the same as in FIG. 2, and explanations of those components will be omitted.

The magnetic circuit of the second embodiment of the present disclosure is shaped such that the yokes 2*a*, 2*b* protrude from the flat surfaces (surface A(a) and surface A(b)) that are surrounded in the axial direction and magnetic pole direction of the magnets 1*a*, 1*b*.

The magnetic force lines that are emitted from the magnets 1*a*, 1*b* are concentrated in the yokes 2*a*, 2*b* by way of the contact surfaces between the magnets 1*a*, 1*b* and the yokes 2*a*, 2*b*. The concentrated magnetic force lines make a loop from the N pole on the tip-end section of the protruding section of the yoke 2*a* toward the S pole on the tip-end section of the protruding section of the yoke 2*b*.

By making the yokes 2*a*, 2*b* protrude out from the magnets 1*a*, 1*b*, the magnetic flux is concentrated in the yokes 2*a*, 2*b*, which is effective in making the magnetic flux density stronger.

Embodiment 3

Figure 8:
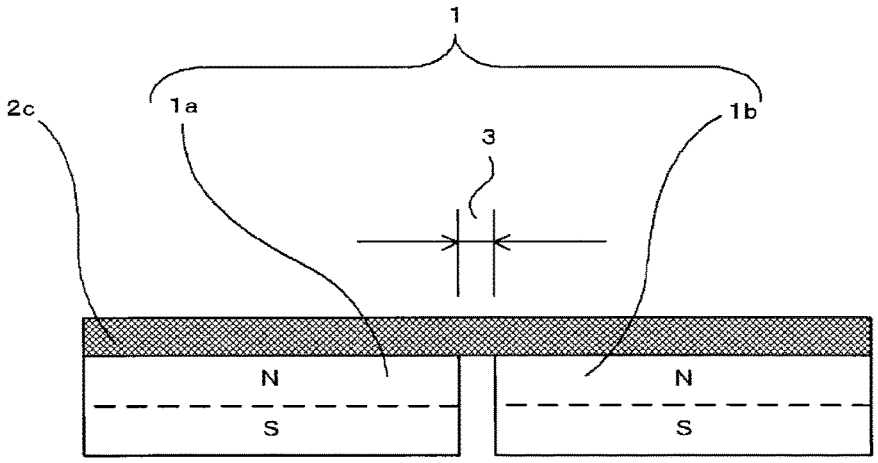
FIG. 8 is a side view illustrating a magnetic circuit of a third embodiment of the present disclosure.
Figure 9:
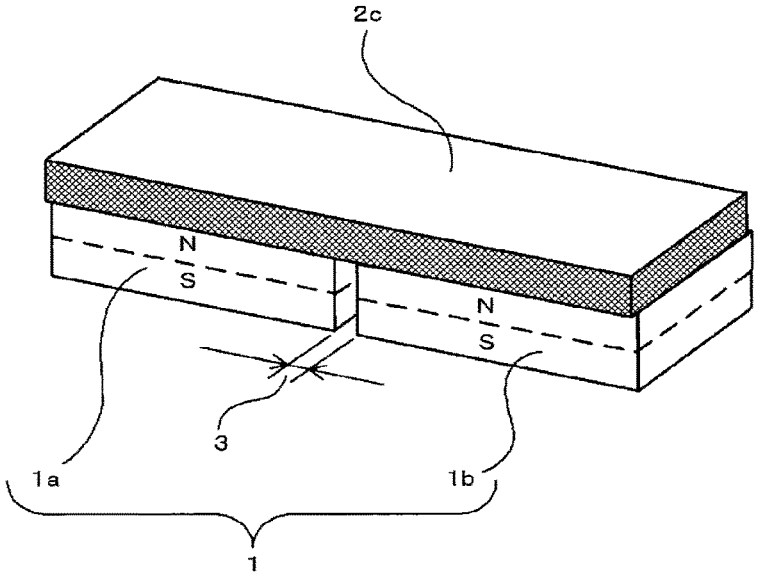
FIG. 9 is a perspective view illustrating a magnetic circuit of a third embodiment of the present disclosure.

A third embodiment of the present disclosure will be explained with reference to the drawings. FIG. 8 is a side view illustrating a magnetic circuit of the third embodiment of the present disclosure. Moreover, FIG. 9 is a perspective view illustrating the magnetic circuit of the third embodiment of the present disclosure.

The magnetic circuit of the third embodiment of the present disclosure is a magnetic circuit in which a ferrous-based metal yoke 2*c* is provided on one magnetic pole side (for example the N pole side). The other construction is the same as that of the magnetic circuit of the first embodiment. In the figures, the yoke 2*c* is provided on the N pole side, however, it is also possible to provide the yoke 2*c* on the S pole side instead of the N pole side.

Next, the uniformity of the magnetic flux density of this magnetic circuit will be explained using FIG. 10A, FIG. 10B, FIG. 11A and FIG. 11B.

Figure 10A:
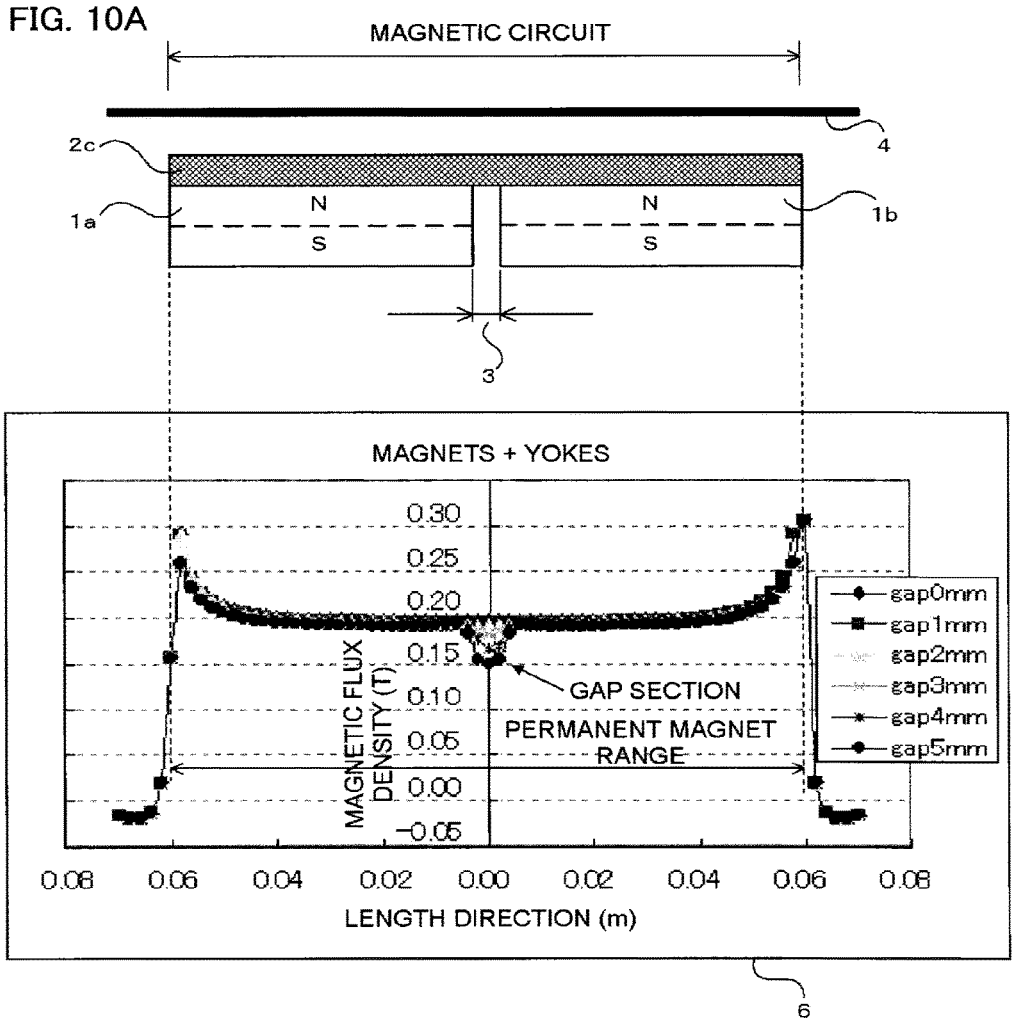
FIG. 10A is a drawing illustrating the magnetic flux density distribution of a magnetic circuit of a third embodiment of the present disclosure.
Figure 10B:
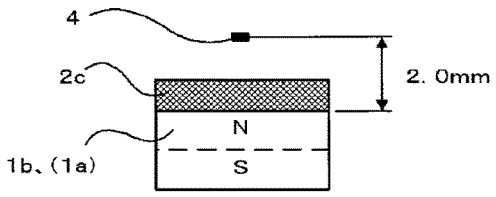
FIG. 10B is a drawing for explaining the installation position of a measurement device.

The graph 6 illustrated in FIG. 10A is a graph illustrating the magnetic flux density distribution at a position that is separated 2 mm from the surface of the N pole side of the magnets with the yoke 2*c* in between (in other words, the position where the measurement device 4 illustrated in FIG. 10A and FIG. 10B is located). The dashed lines in FIG. 10A indicate the correlation between the horizontal axis of graph 6 and the magnetic circuit. Graph 6 illustrates the measurement results when the gap 3 between magnets is changed in 1 mm units from 0 mm to 5 mm. The vertical axis is the magnetic flux density, and the horizontal axis is the length in the axial direction of the magnetic circuit. It can be seen that even when the gap 3 between magnets increases, the magnetic flux density around the gap 3 between magnets does not change much. From this, it can also be seen that even though a yoke 2*c* is provided on only one magnetic pole side, uniform magnetic flux density can be obtained over the entire length in the axial direction.

Figure 11A:
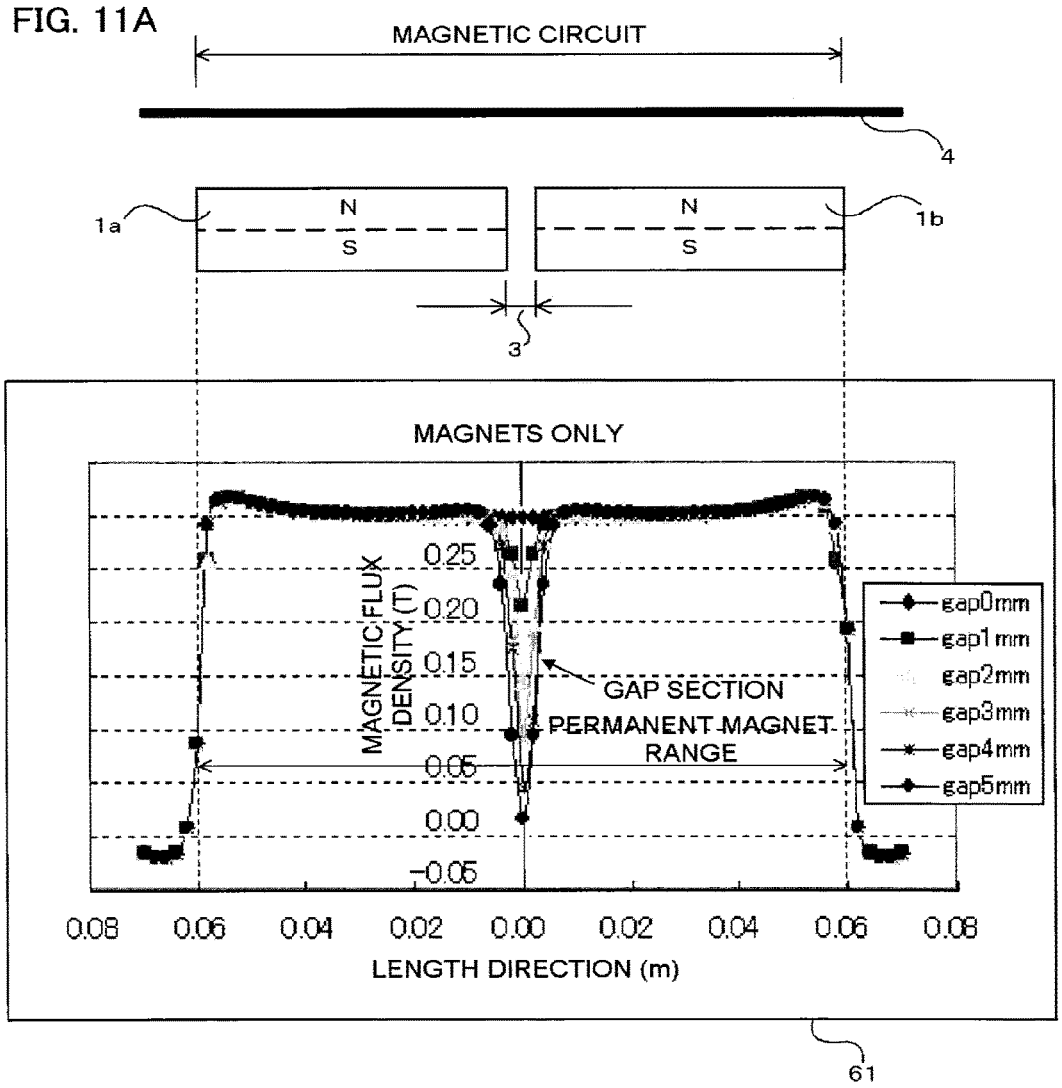
FIG. 11A is a drawing illustrating the magnetic flux density distribution of a magnetic circuit with the yokes removed from a magnetic circuit of a third embodiment of the present disclosure.
Figure 11B:
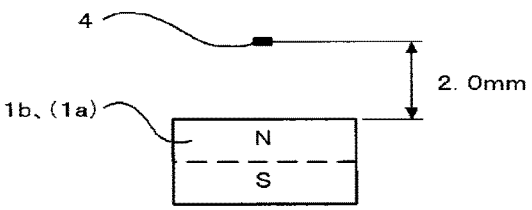
FIG. 11B is a drawing for explaining the installation position of a measurement device.

For a comparison, the yoke 2*c* was removed from the construction described above and the magnetic flux density was measured. The graph 61 illustrated in FIG. 11A is a graph illustrating the results of measuring the magnetic flux density under the same conditions as in the graph 6 illustrated in FIG. 10A (in other words, the results of measuring the magnetic flux density at the position where the measurement device 4 illustrated in FIG. 11A and FIG. 11B is located). The dashed lines in FIG. 11A indicate the correlation between the horizontal axis of graph 61 and the magnetic circuit. As in graph 6, graph 61 illustrates the measurement results when the gap 3 between magnets is changed in 1 mm units from 0 mm to 5 mm. It can be seen that as the gap 3 between magnets increases, the magnetic flux density around the gap 3 between magnets greatly changes. Therefore, it can be seen that when a yoke 2*c* is not provided, uniform magnetic flux density cannot be maintained around the gap 3 between magnets.

As described above, with the magnetic circuit of the third embodiment of the present disclosure, even though a ferrous-based metal yoke 2*c* is provided on only one magnetic pole side, it is possible to obtain uniform magnetic flux density in the axial direction as in the case of the magnetic circuit of the first embodiment.

Figure 12:
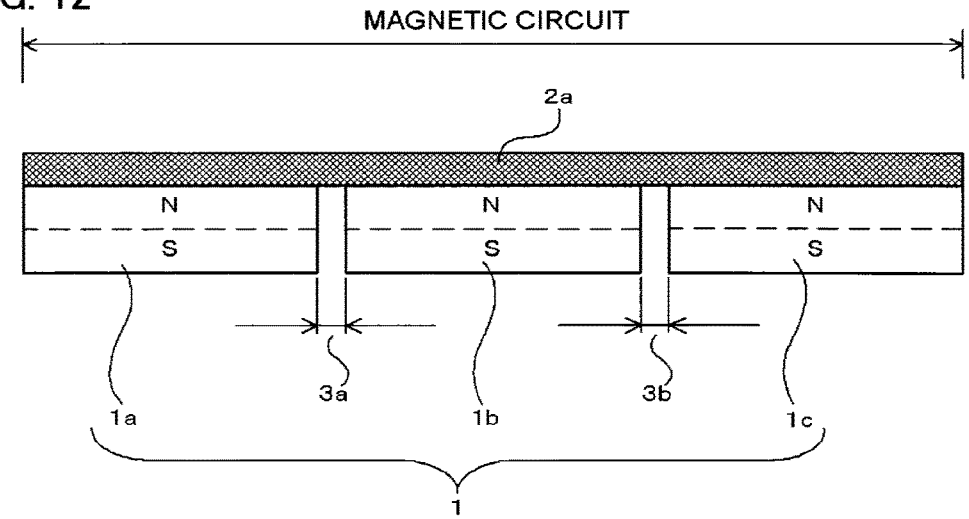
FIG. 12 is a side view illustrating another example of a magnetic circuit of a third embodiment of the present disclosure.

In the third embodiment, the case of arranging two magnets in an array was explained, however, the number of magnets arranged is not limited to two. For example, as illustrated in FIG. 12, it is also possible to arrange three magnets in an array, and to provide a yoke that spans across all of the arranged magnets. Naturally, construction is also possible in which four or more magnets are arranged. Even in the case where three or more magnets are arranged in an array, the same effect as when two magnets are arranged can be obtained.

Embodiment 4

Figure 13:
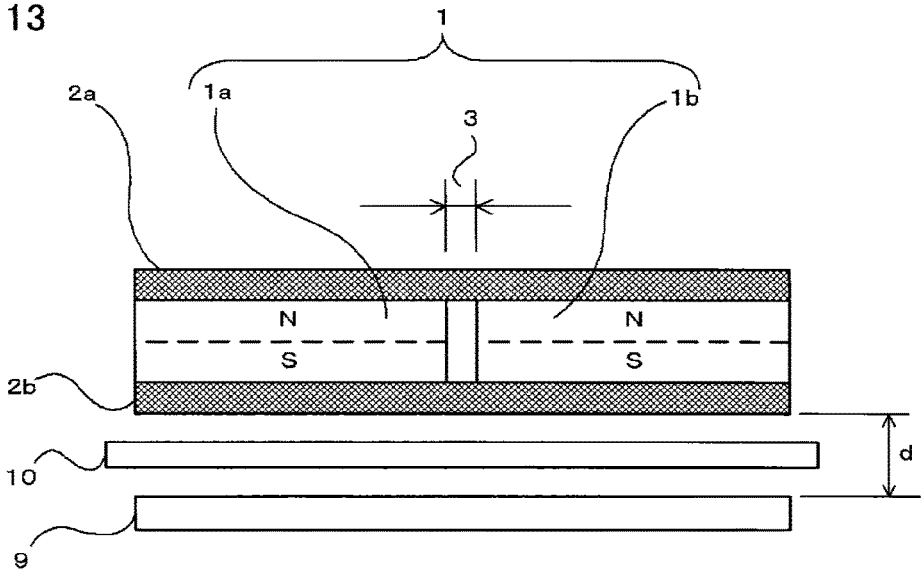
FIG. 13 is a side view illustrating a magnetic circuit of a fourth embodiment of the present disclosure.
Figure 14:
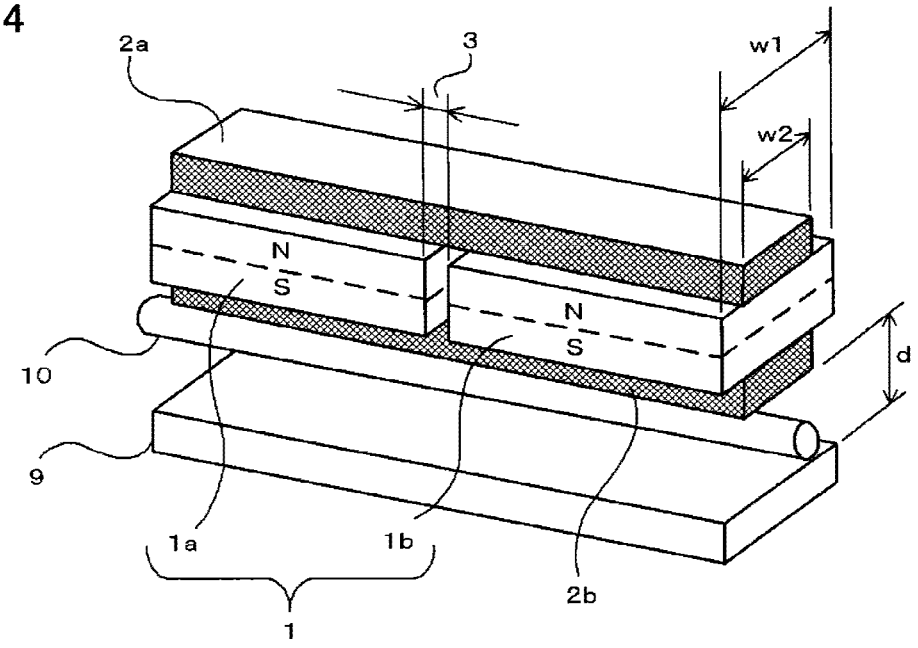
FIG. 14 is a perspective view illustrating a magnetic circuit of a fourth embodiment of the present disclosure.

A fourth embodiment of the present disclosure will be explained with reference to the drawings. FIG. 13 is a side view illustrating a magnetic circuit of the fourth embodiment of the present disclosure. Moreover, FIG. 14 is a perspective view illustrating the magnetic circuit of the fourth embodiment of the present disclosure.

In the magnetic circuit of the fourth embodiment of the present disclosure, a ferrous-based metal plate 9 is provided. The metal plate 9 is arranged parallel to the arrangement direction (arrangement direction of the array) of the magnet 1*a* and the magnet 1*b*. Moreover, the metal plate 9 is located at a position that is separated from the surface of the outside yoke 2*b* by a distance d so that an object 10 is positioned between the yoke 2*b* and the metal plate 9. The object 10 is an object to which the magnetic effect of the magnetic circuit will be applied. As illustrated in FIG. 14, the width w2 of the yoke 2*a* and the yoke 2*b* is shorter than the width w1 of the magnet 1*a* and the magnet 1*b*. The other construction is the same as that of the magnetic circuit of the first embodiment.

In the figures, the metal plate 9 is provided on the S pole side, however, construction is also possible in which the metal plate 9 is provided on the N pole side instead of the S pole side. Moreover, construction is also possible in which a metal plate 9 is provided on both the N pole side and the S pole side.

Next, the uniformity of the magnetic flux density of this magnetic circuit will be explained using FIG. 15A, FIG. 15B, FIG. 16A and FIG. 16B.

Figure 15A:
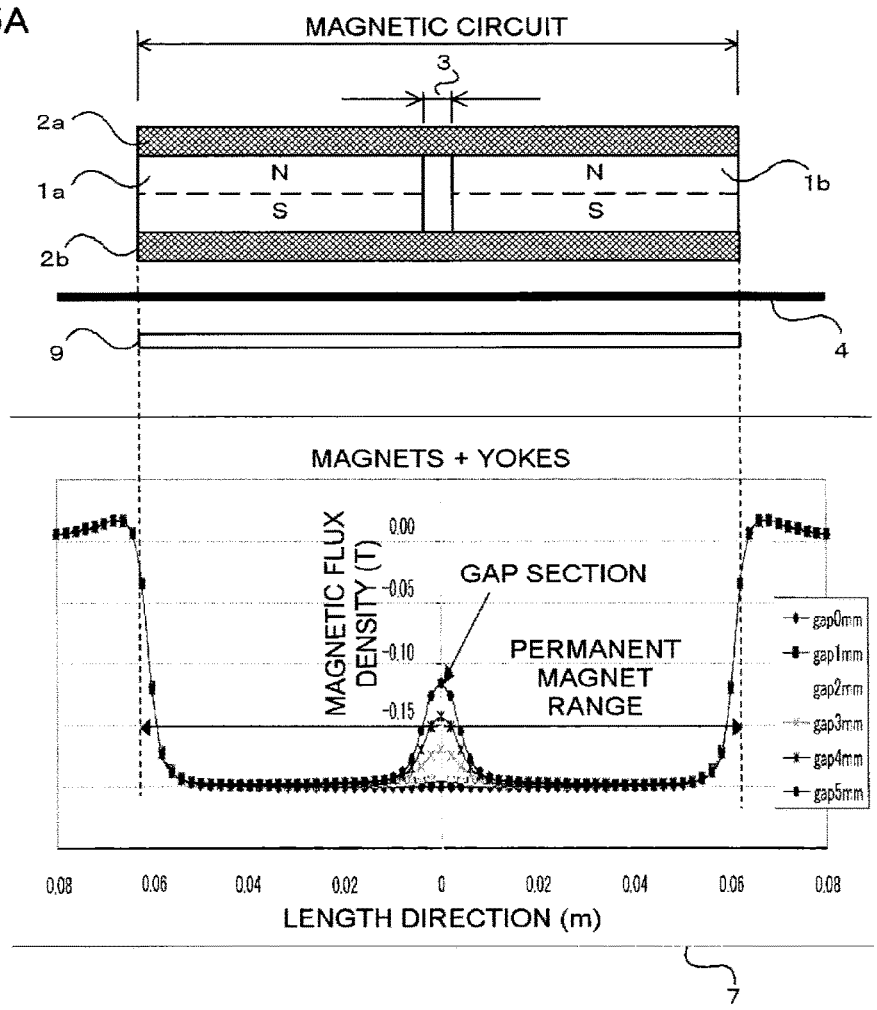
FIG. 15A is a drawing illustrating the magnetic flux density distribution of a magnetic circuit of a fourth embodiment of the present disclosure.
Figure 15B:
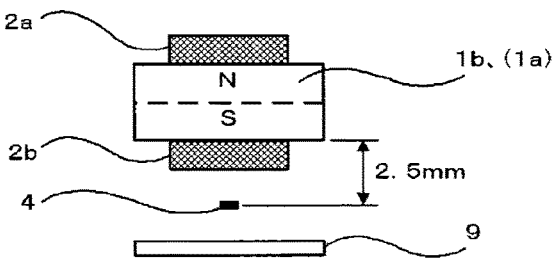
FIG. 15B is a drawing for explaining the installation position of a measurement device.

The graph 7 illustrated in FIG. 15A is a graph illustrating the magnetic flux density distribution at a position that is separated 2.5 mm from the surface of the S pole side of the magnets with the yoke 2*b* in between (in other words, the position where the measurement device 4 illustrated in FIG. 15A and FIG. 15B is located). The dashed lines in FIG. 15A indicate the correlation between the horizontal axis of graph 7 and the magnetic circuit. Graph 7 illustrates the measurement results when the gap 3 between magnets is changed in 1 mm units from 0 mm to 5 mm. The vertical axis is the magnetic flux density, and the horizontal axis is the length in the axial direction of the magnetic circuit. It can be seen that even when the gap 3 between magnets increases, the magnetic flux density around the gap 3 between magnets does not change much.

Figure 16A:
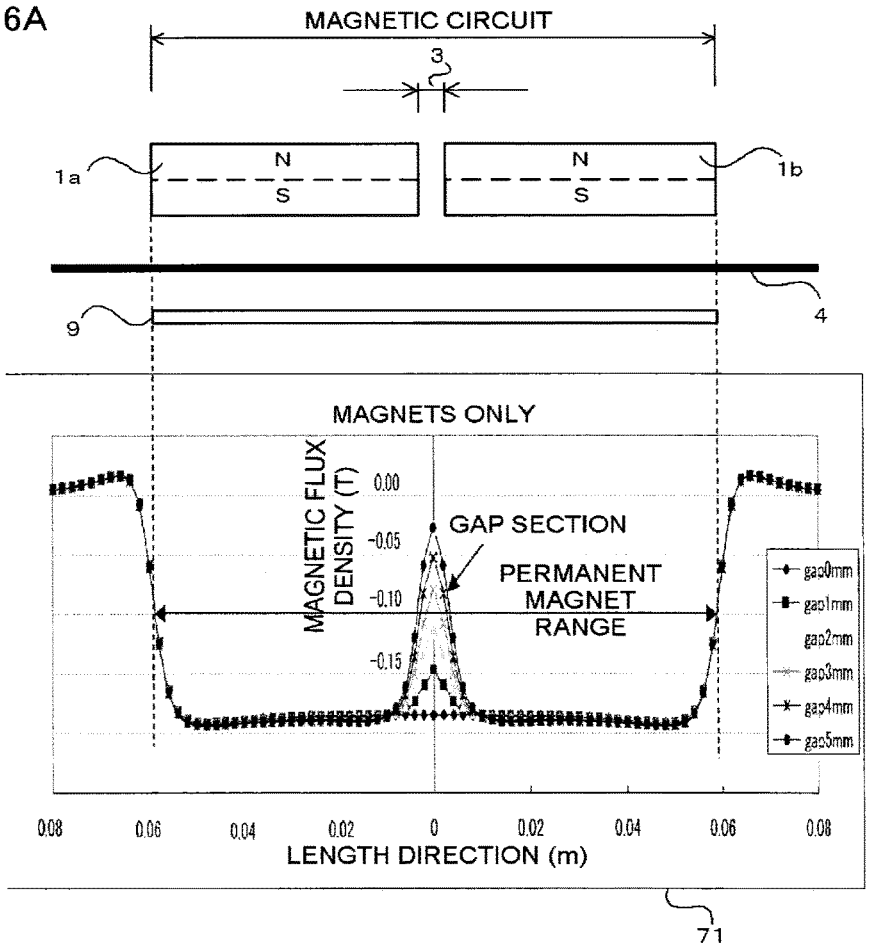
FIG. 16A is a drawing illustrating the magnetic flux density distribution of a magnetic circuit with the yokes removed from a magnetic circuit of a fourth embodiment of the present disclosure.
Figure 16B:
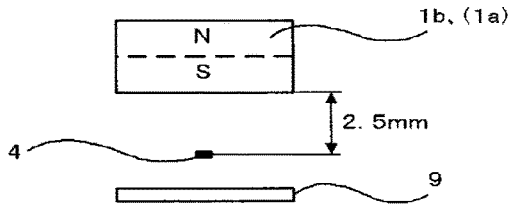
FIG. 16B is a drawing for explaining the installation position of a measurement device.

For comparison, the yoke 2*a* and the yoke 2*b* were removed from the construction above and the magnetic flux density was measured. The graph 71 illustrated in FIG. 16A is a graph illustrating the results of measuring the magnetic flux density under the same conditions as the graph 7 illustrated in FIG. 15A (in other words, the results of measuring the magnetic flux at the position where the measurement device 4 illustrated in FIG. 16A is located). The dashed lines in FIG. 16A indicate the correlation between the horizontal axis of graph 71 and the magnetic circuit. As in graph 7, graph 71 illustrates the measurement results when the gap 3 between magnets is changed in 1 mm units from 0 mm to 5 mm. It can be seen that as the gap 3 between magnets increases, the magnetic flux density around the gap 3 between magnets greatly changes. Therefore, it can be seen that when the yoke 2*a* and the yoke 2*b* are not provided, uniformity of magnetic flux density cannot be maintained around the gap 3 between magnets.

In order to illustrate the uniformity of the magnetic flux density of this magnetic circuit, the magnetic flux density was also measured at other locations. The measurement results are explained using FIG. 17A, FIG. 17B, FIG. 18A and FIG. 18B.

Figure 17A:
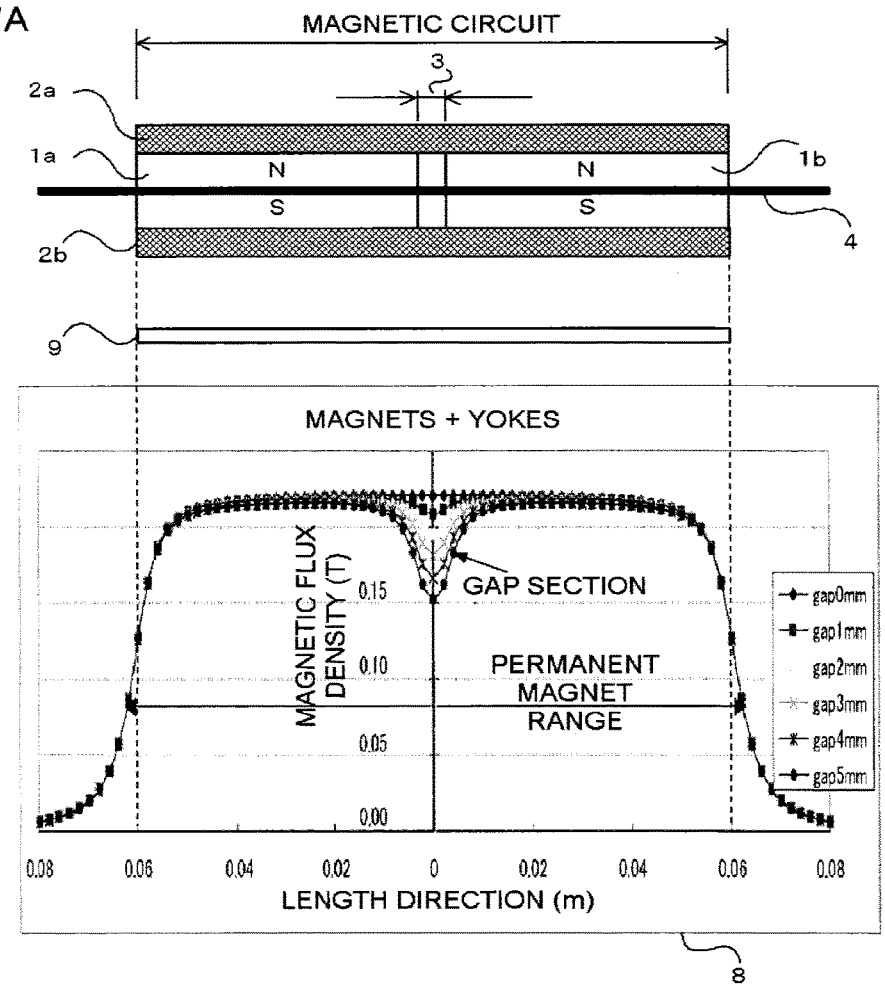
FIG. 17A is a drawing illustrating the magnetic flux density distribution of a magnetic circuit of a fourth embodiment of the present disclosure.
Figure 17B:
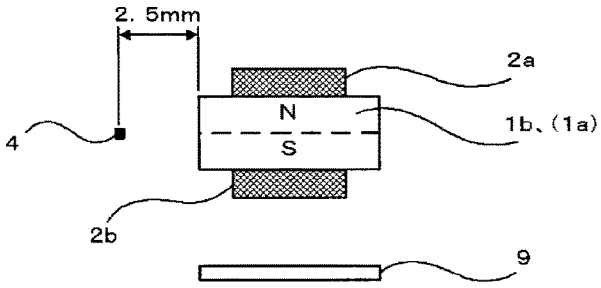
FIG. 17B is a drawing for explaining the installation position of a measurement device.

FIG. 17A illustrates the results of measuring the magnetic flux density using construction that is the same as that of the magnetic circuit illustrated in FIG. 15A. The graph 8 illustrated in FIG. 17A is a graph illustrating the magnetic flux density distribution at a position that is separated 2.5 mm from the side surface of the magnet 1*a* and the magnet 1*b* (in other words, the position where the measurement device 4 illustrated in FIG. 17A and FIG. 17B is located). The dashed lines in FIG. 17A indicate the correlation between the horizontal axis of graph 8 and the magnetic circuit. Graph 8 illustrates the measurement results when the gap 3 between magnets is changed in 1 mm units from 0 mm to 5 mm. It can be seen that even when the gap 3 between magnets increases, the magnetic flux density around the gap 3 between magnets does not change much.

Figure 18A:
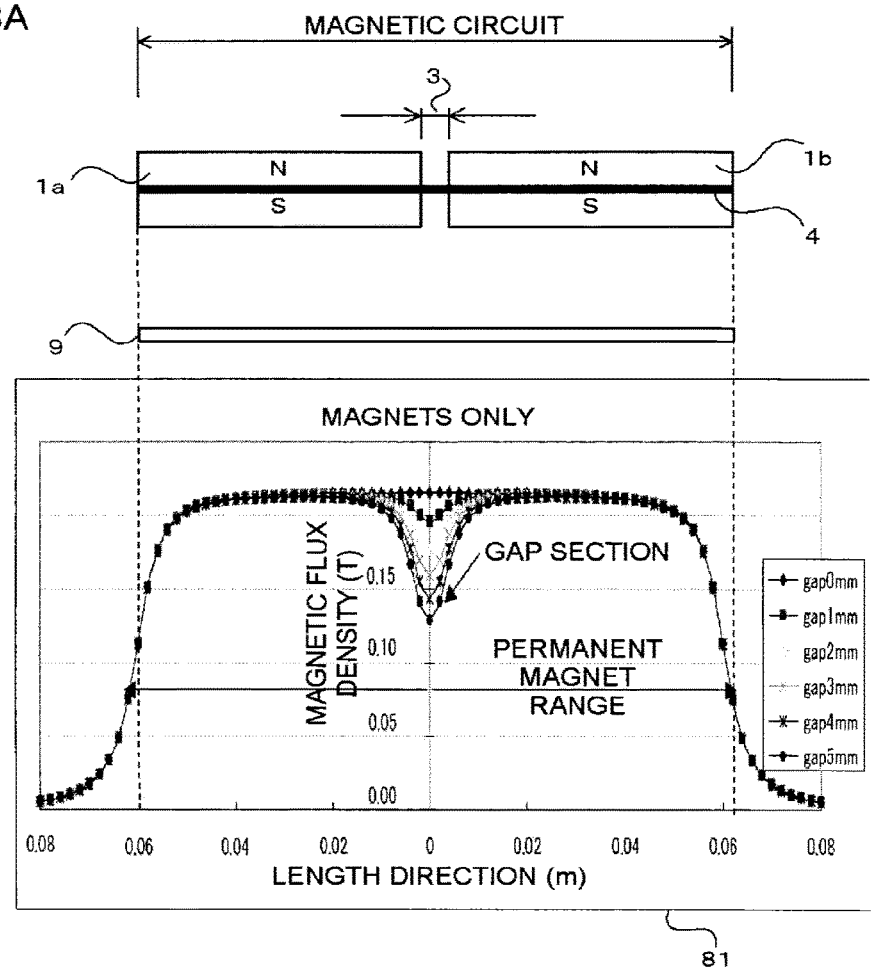
FIG. 18A is a drawing illustrating the magnetic flux density distribution of a magnetic circuit with the yokes removed from a magnetic circuit of a fourth embodiment of the present disclosure.
Figure 18B:
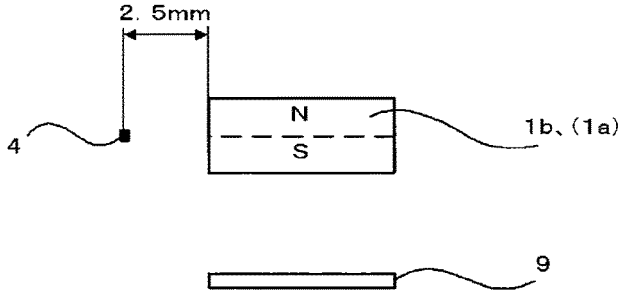
FIG. 18B is a drawing for explaining the installation position of a measurement device.

FIG. 18A is a drawing illustrating the measurement results when using construction that is the same as that of the magnetic circuit illustrated in FIG. 16A (in other words, a magnetic circuit that is obtained by removing the yoke 2*a* and yoke 2*b* from the magnetic circuit illustrated in FIG. 17A) and only the position of the measurement device 4 is changed. The graph 81 illustrated in FIG. 18A is a graph illustrating the results of measuring the magnetic flux density of a magnetic circuit under the same conditions as the graph 8 illustrated in FIG. 17A (in other words, is a graph illustrating the measurement results of measuring the magnetic flux density at the position where the measurement device 4 illustrated in FIG. 18A and FIG. 18B is located). The dashed lines in FIG. 18A indicate the correlation between the horizontal axis of graph 81 and the magnetic circuit. As in graph 8, graph 81 illustrates the measurement results when the gap 3 between magnets is changed in 1 mm units from 0 mm to 5 mm. Even though not as large as that of the graph 71 illustrated in FIG. 16A, it can be seen that as the gap 3 between magnets increases, the magnetic flux density around the gap 3 between magnets greatly changes.

As described above, with the magnetic circuit of the fourth embodiment of the present disclosure, it is possible to obtain uniform magnetic flux density along the axial direction.

The embodiments above can undergo various changes or modifications within the range of the scope of the present disclosure. The embodiments described above are for explaining the present disclosure, and are not intended to limit the range of the invention. The range of the present disclosure is as disclosed in the accompanying claims rather than in the embodiments. Various changes and modifications that are within the range disclosed in the claims or that are within a range that is equivalent to the claims of the invention are also included within the range of the present disclosure.

This specification claims priority over Japanese Patent Application No. 2012-016847, including the description, claims, drawings and abstract, as filed on Jan. 30, 2012. This original Patent Application is included in its entirety in this specification by reference.

REFERENCE SIGNS LIST

1 Magnet body
1*a*, 1*b*, 1*c* Magnet
2*a*, 2*b*, 2*c* Yoke
3, 3*a*, 3*b* Gap between magnets
4 Measurement device
5, 6, 7, 8, 51, 61, 71, 81 Graph
9 Metal plate
10 Object

The invention claimed is:

1. A magnetic circuit comprising:

a plurality of permanent magnets disposed in an array;

a pair of yokes which sandwich the plurality of permanent magnets, each yoke of the pair of yokes being without any openings; and a ferrous plate that is separated by a gap from the yokes and parallel to a length of the yokes, wherein:

each of the plurality of permanent magnets have one magnetic pole disposed closer to one of the pair of yokes, and another magnetic pole disposed closer to the other of the pair of yokes, a space between the yokes where the permanent magnets exist includes only magnetic material where the plurality of permanent magnets are disposed, and the ferrous plate is located in a position that is separated from one of the yokes of the pair of yokes so that an object to which a magnetic effect is to be applied is positioned between one of the yokes of the pair of yokes and the ferrous plate.

2. The magnetic circuit according to claim 1, wherein:

the plurality of permanent magnets include first flat surfaces which face a corresponding one of the yokes, the plurality of permanent magnets include second flat surfaces which face in a direction parallel to a plane of the yokes, and the pair of yokes protrude out from the second flat surfaces.

3. The magnetic circuit according to claim 1, wherein:

a cross-sectional shape of the plurality of permanent magnets in a direction orthogonal to a width of the array of the permanent magnets and orthogonal to a plane of the yokes is rectangular.

4. The magnetic circuit according to claim 1, wherein:

a cross-sectional shape of the plurality of permanent magnets in a direction orthogonal to a length of the array of the permanent magnets and orthogonal to a plane of the yokes is rectangular.

5. The magnetic circuit according to claim 1, wherein:

said one magnetic pole of each of the plurality of permanent magnets contacts said one of the pair of yokes, and said another magnetic pole of each of the plurality of permanent magnets contacts said another of the pair of yokes.

6. The magnetic circuit according to claim 1, wherein:

the magnetic poles of each of the plurality of permanent magnets have a same orientation.

* * * * *